US008328966B1

(12) United States Patent
Laib et al.

(10) Patent No.: US 8,328,966 B1
(45) Date of Patent: Dec. 11, 2012

(54) METHOD FOR MAKING MINIATURE EXPLOSIVE POWDER CHARGES

(75) Inventors: Gerald R. Laib, Olney, MD (US); Michael Beggans, Waldorf, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 1126 days.

(21) Appl. No.: 12/283,783

(22) Filed: Sep. 11, 2008

(51) Int. Cl.
*D03D 23/00* (2006.01)
*D03D 43/00* (2006.01)

(52) U.S. Cl. ..... 149/109.6; 149/108.8; 149/109.4

(58) Field of Classification Search ..... 149/109.6, 149/108.8, 109.4
See application file for complete search history.

(56) References Cited

U.S. PATENT DOCUMENTS 4,428,906 A * 1/1984 Rozmus ..... 419/48
6,406,663 B1 * 6/2002 Goransson ..... 419/38
6,837,696 B2 * 1/2005 Sowden et al. ..... 425/112
7,140,856 B2 * 11/2006 Zeddies et al. ..... 425/78
7,150,617 B1 * 12/2006 Lowell et al. ..... 425/78

OTHER PUBLICATIONS

E.Roos, J.Benterou, R.Lee, Roeske and B.Stuart,"Femtosecond Laser Interaction with Energetic Materials",Symposium, Taos, NM., Apr. 24, 2002.
U.S. Appl. No. 12/283,782, filed Sep. 11, 2008, Laib, et al.

* cited by examiner

*Primary Examiner* — James McDonough
(74) *Attorney, Agent, or Firm* — Fredric J. Zimmerman

(57) ABSTRACT

A method for making miniature explosive powder charges or other compressible materials, including providing a material to be compressed into multiple cavities of a rigid platen, and positioning an elastic platen in contact with the rigid platen. The elastic platen is mounted in a head assembly having a pressurizing fluid. Evacuating the cavities and the material contained therein, and trapping fractious particles and vapors out-gassed from the material. Pressurizing fluid, which causes deformation of the elastic platen to form distensions that project into the cavities and compress the material into compacts. The pressurizing fluid is depressurized enabling the distensions to retract and the elastic platen to return to a non-deformed state. Finally, separating the elastic and rigid platens and collecting the compacts, which may be miniature explosive charges having an optimized density.

18 Claims, 8 Drawing Sheets

METHOD FOR MAKING MINIATURE EXPLOSIVE POWDER CHARGES

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The present invention relates generally to compaction presses, and in particular to a method and an apparatus for compacting explosive materials easily and safely to form miniature charges of optimized density.

2. Description of the Conventional Technology

With the miniaturization of munitions and their components, there is a growing need for technology for reliably fabricating primary charges of increasingly smaller diameters. There exist several methods, for example ink-jet printing and femtosecond laser cutting, by which explosive materials can be formed in small volumes, however there are some drawbacks. Laser cutting methods cannot be used with most materials, including primary explosives, such as, lead azide and lead styphnate, which detonate if irradiated with a laser sufficient for ablating material. (Roos, E., Benterou, J., Lee, R., Roeske, F., & Stuart, B. (2002). *Femtosecond laser interaction with energetic materials* (Preprint UCRL-JC-145670. pp. 11) Taos, NM: SPIE: International Symposium High-Power Laser Ablation. In addition, ink-jet and other methods leave a charge with less than optimal density.

Miniature rams have been used to compact charges in rigid cavities, however, as the dimensions of the cavity decrease, the rams become more prone to breakage; and variations in diameter and alignment become a greater concern. Also, the technology is difficult to scale as multiple needle-like rams across a broad area are susceptible to skew, bending and breakage due to otherwise small variations in alignment, flatness, and load height of the explosive in the cavities. Tooling of the cavities and rams becomes more difficult and expensive.

A schematic of a prior art ram press 100 is shown in FIG. 1. The press 100 includes a rigid platen 42 with a plurality of cavities 44. The cavities are filled with powdered charge material. The powdered charge material is compacted by a ram 132, one ram per cavity where each ram is typically rigid and not deformable, thus forming the charge 70. The schematic illustrates the position of the rams after compression and retraction of the ram. The multiple rams depend from the press head plate 130 driven by cylinder 140.

In the current art, miniature charges are now on the order of 1 millimeter in diameter and 0.5 millimeters thick. Therefore, the rams used in the prior art apparatus 100 are just under 1 millimeter in diameter, and their margin of error (e.g. tolerance) must be correspondingly small.

Needed are a method and an apparatus to compress small samples of powders, such as primary explosives. The samples can be formed by ink-jet printing and the like, and then compacted easily and safely to form miniature charges of optimized density.

SUMMARY OF THE INVENTION

The invention is a method and an apparatus for compressing powders, and more particularly a method and an apparatus for making miniature explosive powder charges. The apparatus comprises a head assembly with a distensible elastic platen mounted in a chambered header plate containing a pressurizing fluid. The elastic platen distends, where possible, in response to the pressure of the pressurizing fluid. Alternatively stated, when there is an increase in the pressure in the chambered header plate, the distensible elastic platen will deform under adequate pressure forming one or more distensions, and as the elastic platen distends there will be an increase in volume of pressurizing fluid in the head assembly. Conversely, when there is a reduction in the pressure, the distension will retract with a coincident decrease in the volume. The apparatus has a base assembly with a rigid platen mounted in a base plate. The rigid platen has a face with at least one cavity. Each cavity has an opening that opens to the face of the rigid platen. The elastic platen is aligned with the rigid platen. Compression occurs when the platens are in contact. During compression, the elastic platen deforms forming the one or more distensions, one distention per cavity that extends into the cavity. The elastic platen cannot distend against the face of the rigid platen, as the platens are held firmly in contact. The shape of the cavity, such as the diameter, will largely'determine the diameter of the distension. Operationally, a distension acts as a ram having variable length and diameter. The length of the distension is a function of several factors; amongst them are the depth of the cavity, the amount of material in the cavity, and the density of the material. In the case of a cavity filled with a fluffy loose powder having a low density, the distension pushes the powder toward the bottom (or the rear, depending on the orientation of the cavity) of the cavity to a point where the material is compacted to a density that resists further densification. Higher pressure may result in greater compaction and densification with coincident extension of the distension. If the starting powder is more granular, then generally there will be less densification because the stating material is denser. The apparatus is especially suitable for safely and easily compacting a plurality of small samples of explosives and the like, and in particular primary and high explosives, therein forming miniature charges of optimized density. The small samples are generally created using ink-jet technology, and then several of these small samples are combined to form miniature charges.

The elastic platen includes a non-tacky polymer having substantially no adherence to the cavity or the various powders or plurality of small samples. The polymer is deformable when pressurized, and retracts cleanly and readily when the pressure is released.

A cavity can have one or more air outlets that provide an expulsion route for air entrained in the cavity. Alternatively, the cavity can be evacuated.

The method for compressing powders and the like includes providing a material to be compressed to at least one cavity having an opening that opens to a face of a rigid platen; positioning an elastic platen aligned and held firmly in contact with and, in an alternate embodiment, within, the rigid platen, where the elastic platen is mounted in a head assembly having a chambered header plate with a pressurizing fluid; and pressurizing the pressurizing fluid causing the elastic platen to deform forming distensions which project into the at least one cavity, thereby compressing the material therein into compacts. Depressurizing the pressurizing fluid enables the distensions to retract and the elastic platen to return to a non-deformed state. The platens may be separated and the compacts are collected. If the cavities are evacuated, evacuation generally occurs after the platens are in contact.

The naming convention employed in this disclosure utilizes the accepted notation that articles "a" and "an" can denote one or more, and are not limited to a single number.

BRIEF DESCRIPTION OF THE DRAWINGS

The foregoing invention will become readily apparent by referring to the following detailed description and the appended drawings in which.

DETAILED DESCRIPTION OF EXEMPLARY EMBODIMENTS OF THE INVENTION

Figure 1:
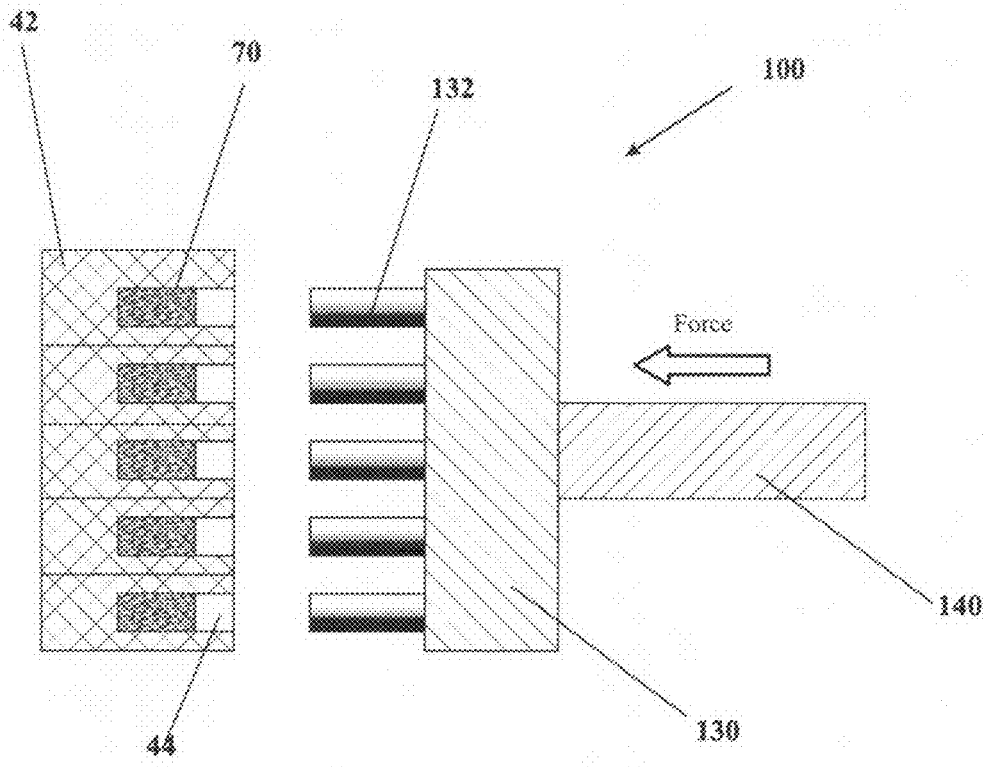
FIG. 1 (Prior Art)
FIG. 1 is a schematic illustration of a conventional art ram press.
Figure 2:
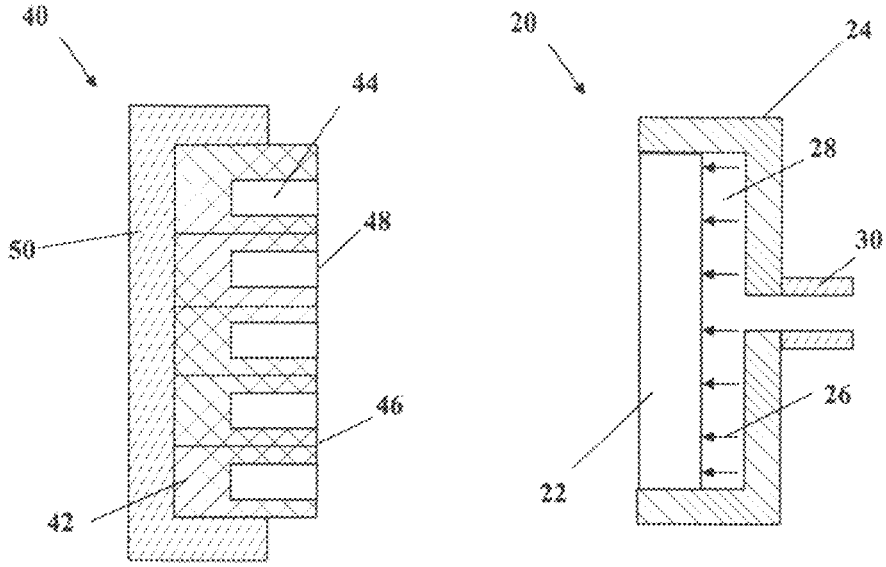
FIG. 2 is a schematic of the head and base assembly of an illustrated embodiment of the invented apparatus.
Figure 3A:
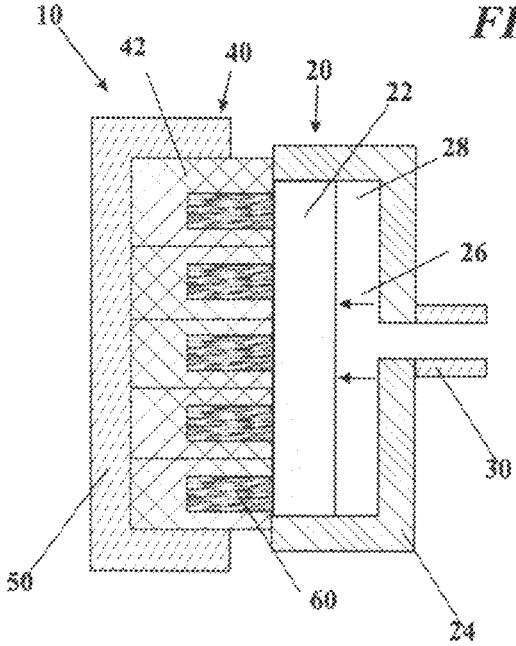
FIG. 3*a* is a schematic illustration of the apparatus loaded with powder or small samples not yet compacted.

The apparatus is a means for compacting materials to a desired density, and is particularly suitable for safely and easily compacting a plurality of small samples of explosives and the like, and in particular primary and high explosives, therein forming miniature charges of optimized density. The apparatus 10, as shown in FIG. 2 and FIG. 3*a*, includes a head assembly 20 and base assembly 40. The head assembly 20 includes a distensible elastic platen 22 mounted in a chambered header plate 24 containing a pressurizing fluid 26 that is conveyed through a fluid line 30. In the schematic illustration, the exemplary chambered header plate 24 has only one chamber 28, but in another exemplary embodiment, additional chambers may be employed if necessary. The arrows are representative of the pressurizing fluid 26, which applies a uniform pressure to the back of the distensible elastic platen 22. The base assembly 40 includes a rigid platen 42 mounted in a base plate 50. The rigid platen 42 has a face 46 with at least one cavity 44, each cavity 44 having an opening 48 that extends and opens to the face 46 of the rigid platen 42. In an exemplary embodiment, five cavities are illustrated in the schematic; however the rigid platen 42 could have many more cavities of various dimensions, such that many powder samples could be simultaneously compressed to the same density.

Figure 3B:
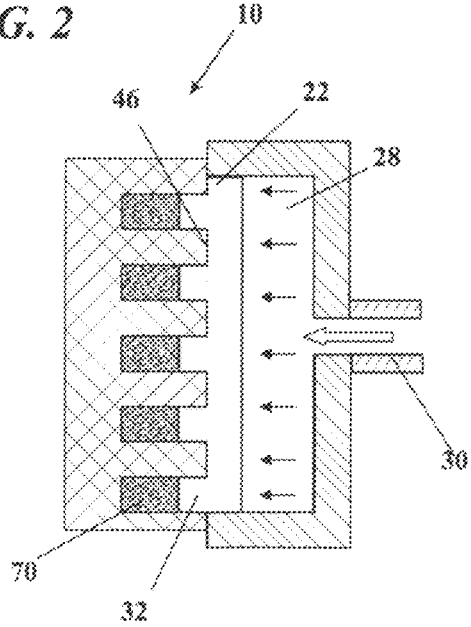
FIG. 3*b* is a schematic illustration of the apparatus during compression, wherein the distensions have densified the loaded powder or small samples to an optimized density.

Referring to FIG. 3*a*, a material, such as, loose powder and/or inkjet samples 60 are preloaded into the cavities and the distensible elastic platen 22 is held firmly in contact with the surface 46 of the rigid platen 42. Referring to FIG. 3*b*, pressurizing fluid 26 is pumped into the chamber through fluid line 30. The uniform pressure causes the distensible elastic platen 22 to expand. The base assembly and the head assembly are held firmly together such that the only available expansion is a deformation of the distensible elastic platen 22. The distensible elastic platen 22 deforms producing a single distension 32 per cavity. The distension 32 extends through the opening 48 compressing the loose powder and/or small samples 60. The compression densifies the loose powder and/or small samples 60 forming miniature charges or miniature samples 70 of optimized density.

The distensible elastic platen 22 is composed of a non-tacky elastomeric polymer, having substantially no adherence to the cavity or the various powders. The polymer is deformable when pressurized, and retracts cleanly and readily when the pressure is released. The elastomeric polymer is selected from the group consisting of a silicone rubber, a polyurethane rubber, a polyacrylate rubber, a natural rubber, and a combination thereof. Various grades of these polymers have excellent elongation and recovery (retraction). To facilitate a clean release the distensible elastic platen can be coated with a release agent, such as a silicone release, a fluorinated compound or polyvinyl N-octadecyl carbamate(pvodc).

In an exemplary embodiment, the elastomeric polymer is intrinsically of low tack or is compounded to have low tack, and retracts cleanly and readily, not adhering to the cavity or to the preloaded powder or the compressed powder. In an exemplary embodiment, Polydimethylsiloxane (i.e. silicone rubber or PDMS) has good release properties, it is substantially inert, and it has good recovery (retraction). PDMS is the preferred elastomeric polymer.

Figure 4:
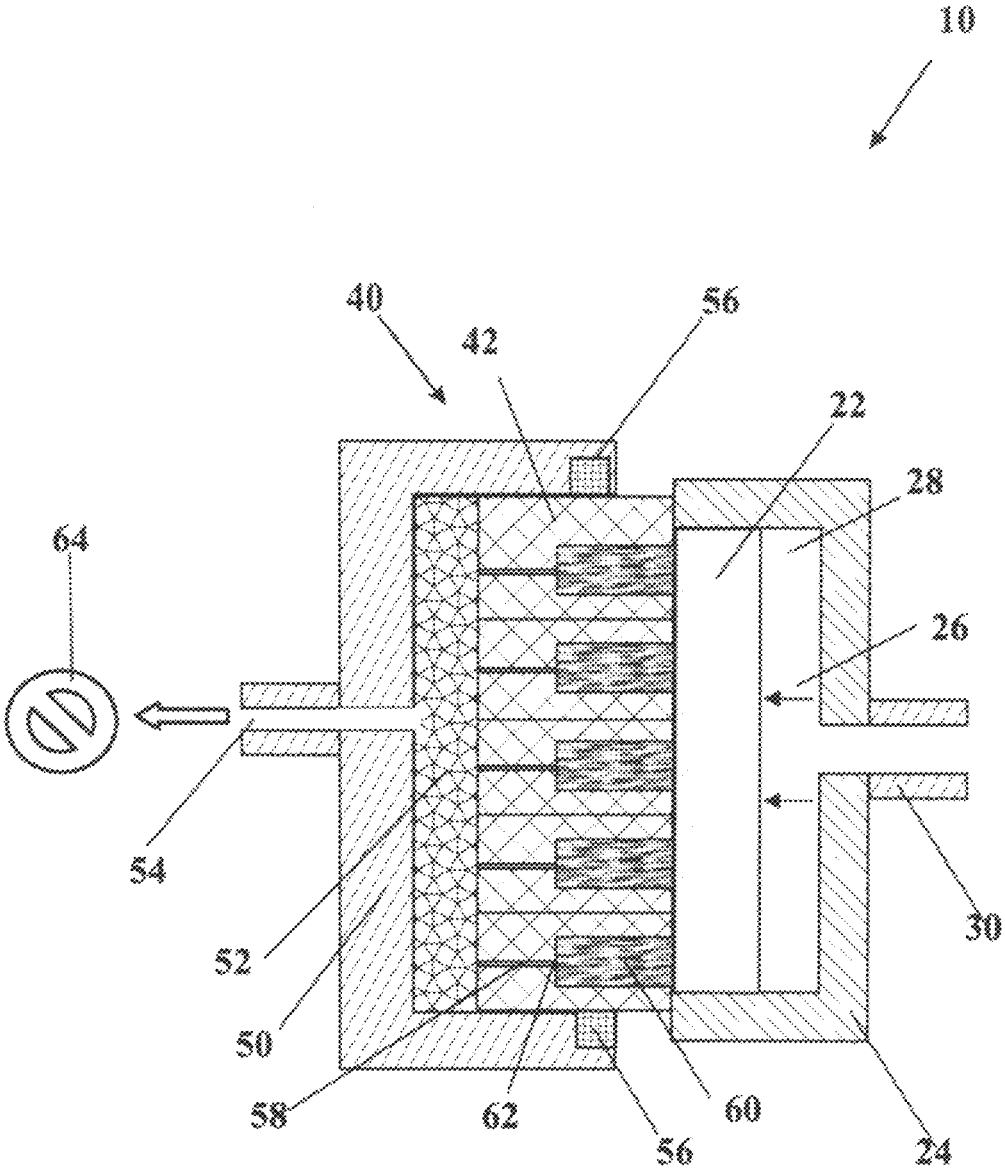
FIG. 4 is a schematic of an illustrated embodiment of a sealed apparatus, where the cavities can be evacuated or otherwise expelled of entrained air through micro-channels, the apparatus having a diffusible membrane and, optionally, other traps to collect potentially explosive fugitive vapors and particulate matter.

The apparatus may further include a means for expelling air entrained in the cavity or in the powder/small samples 60 being compressed. Air outlets in the cavity are a possibility, but when compressing powders of primary explosive, a major concern is where fractious particles of the explosive may stray. Therefore, in an exemplary embodiment, the apparatus employs an evacuation system, as an evacuation system maintains a level of control over where the particles are collected, and the vacuum facilitates the compression and the uniformity of the charge. The vacuum system can also cause outgassing and this situation is addressed. Referring to FIG. 4, the cavities have an exhaust port 62 at the rear of the cavity, which is the deepest point in the cavity in relation to the face 46. The exhaust port 62 leads to, in an exemplary embodiment, a micro-channel 58, a diffusion membrane 52 and a vacuum line 54. The base assembly is fitted with seals 56 to keep out the ambient air. The vacuum line 54 may lead to an additional trap selected from the group consisting of a filter, a centrifugal filter, a cryogenically cooled trap, an absorbent and/or dissolving liquid bath, a semi-permeable membrane, a diffusion membrane or a combination thereof. The trap 64 prevents vapors from reaching the vacuum pump. A cryogenically cooled trap removes both water vapor and organic vapors, and both of these shorten the life and reduce the performance of the pump.

The exhaust port 62 is sized small, but sufficiently large that a vacuum is achieved. Entrapped air results in non-uniform charges. Diffusion membrane 52 prevents particles of the loose powder and/or inkjet samples 60 from being drawn into the vacuum line 54. The diffusion membrane 52 may be contaminated to some degree after each pressing, but the level of contamination is small enough to permit repeated use of the diffusion membrane 52. The diffusion membrane 52 is ultimately replaced and disposed of after a significant number of cycles.

Figure 5:
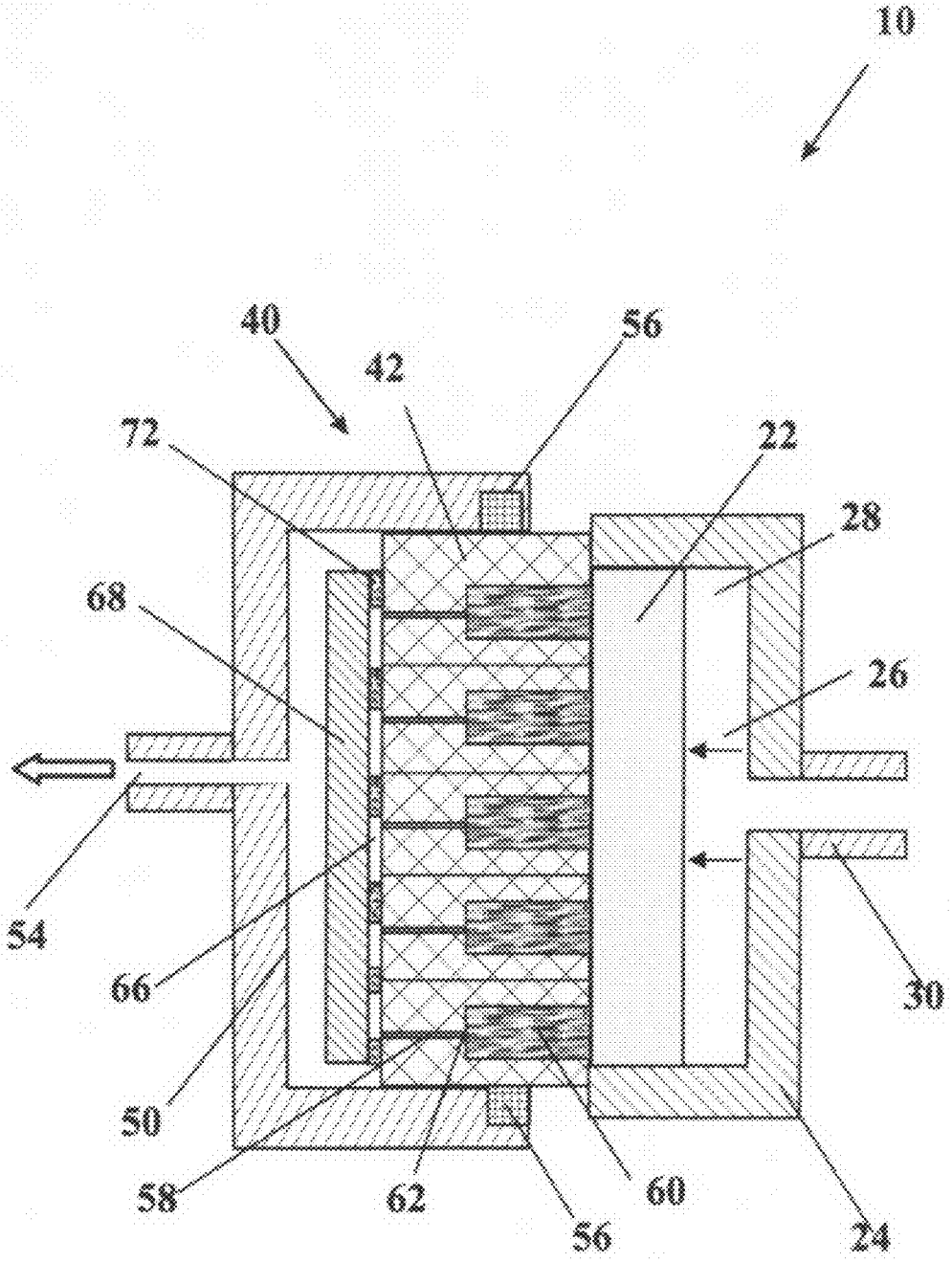
FIG. 5 is a schematic of another illustrated embodiment of the sealed apparatus, where the cavities can be evacuated or otherwise expelled of entrained air through micro-channels in the rigid platen and through an etched silicon wafer that is bonded to the back of the rigid platen, where the silicon wafer is etched with micro-channels that are in right angle fluid communication with the rigid platen micro-channels, the orthogonal orientation reducing the escape of potentially explosive particles from the base assembly.

Another embodiment of the sealed apparatus 10 employing a vacuum system is shown in FIG. 5. An etched silicon wafer 68 is bonded to the back of the rigid platen 42. A photoresist layer 72 of the silicon wafer 68 is etched with micro-channels that are in right angle fluid communication with the rigid platen micro-channels 58. The orthogonal relationship reduces the escape of potentially explosive particles from the cavities 44. This exemplary embodiment lends itself to fabrication using the advantages of photolithography and the developed processes for MicroElectroMechanical Systems (MEMS) that exist for fabricating devices.

Figure 6:
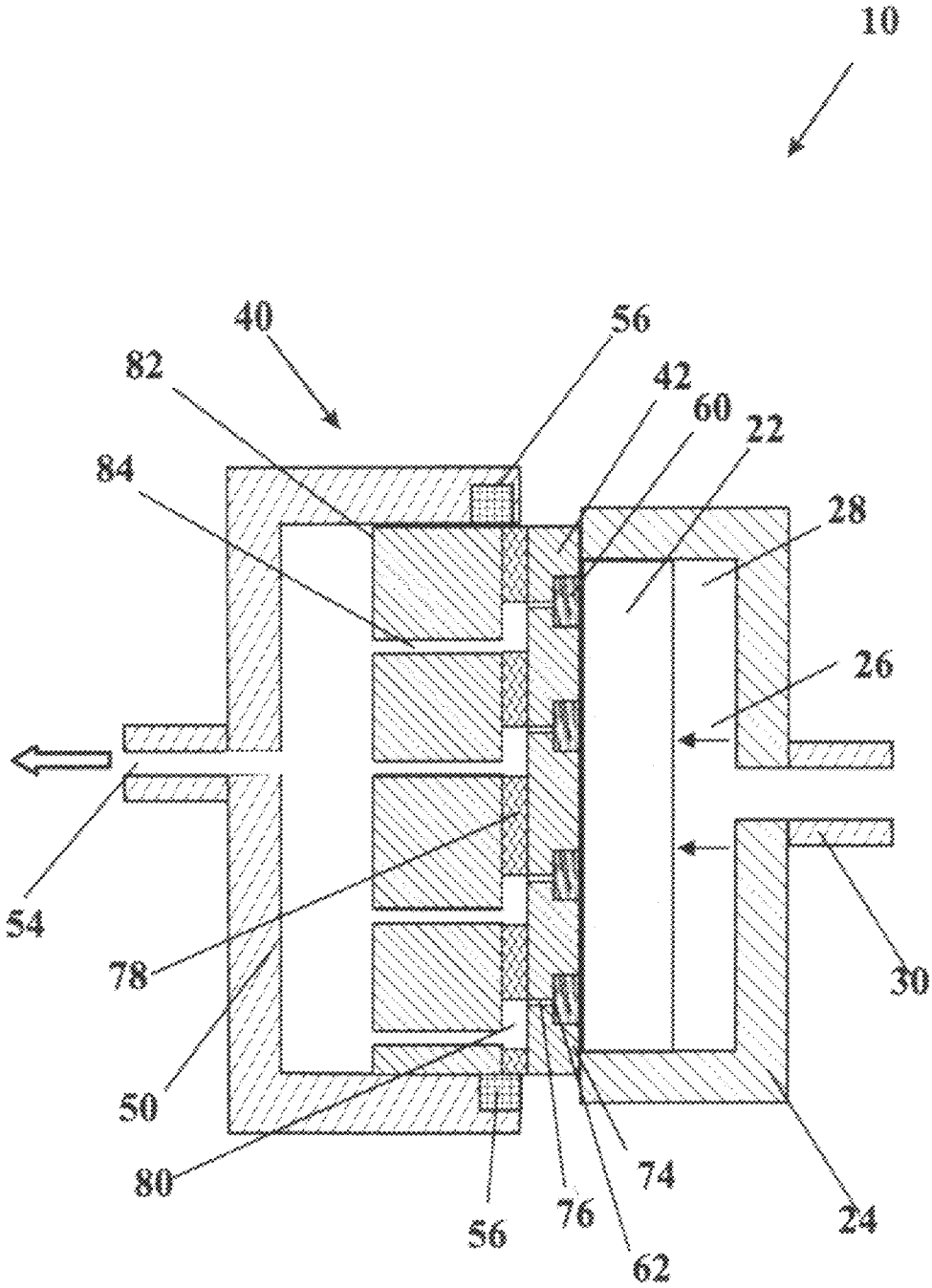
FIG. 6 is a schematic of another illustrated embodiment of the sealed apparatus, where the rigid platen is fabricated using a Silicon-On-Insulator (SOI) wafer, where the cavities are formed in the first silicon layer (top), there are micro-channels are in the first silicon layer, micro-channels in the insulator layer (the first silicon dioxide layer), and micro-channels in the second silicon layer (bottom)

The exemplary embodiment of the apparatus 10 illustrated in FIG. 6 expands on the technology disclosed in FIG. 5. Referring to FIG. 6, the base assembly 40 has a rigid platen 42 that is sealedly mounted in a base plate 50. The rigid platen 42 is generally composed of a silicon on insulator (SOI) wafer. The rigid platen includes the face 46 with at least one cavity 60 etched in a first silicon layer 74 where each cavity has an opening that opens to the face of the rigid platen 42. Further, at least one cavity has an exhaust port 62 that is substantially near a deepest point of the cavity in relation to the face or surface 46. The exhaust port 62 is in fluid communication through a first micro-channel 76 located in the first silicon layer 74. the first micro-channel 76 is in fluid communication with a second micro-channel 80 etched in a first silicon oxide layer 78. The fluid communication extends through a third micro-channel 84 etched in a second silicon layer 82. The fluid communication further extending to the vacuum line 54 connected to the base plate. In the illustration the channels in the oxide layer 80 are exaggerated in scale. In practice, they would only be about 1 to about 2 microns deep (the thickness of a common oxide layer in SOI for MEMS). The micro-channels are offset, and have a circuitous route, and this route reduces particulate explosive material from entering the vacuum pump or other areas of the base assembly 40.

Figure 7:
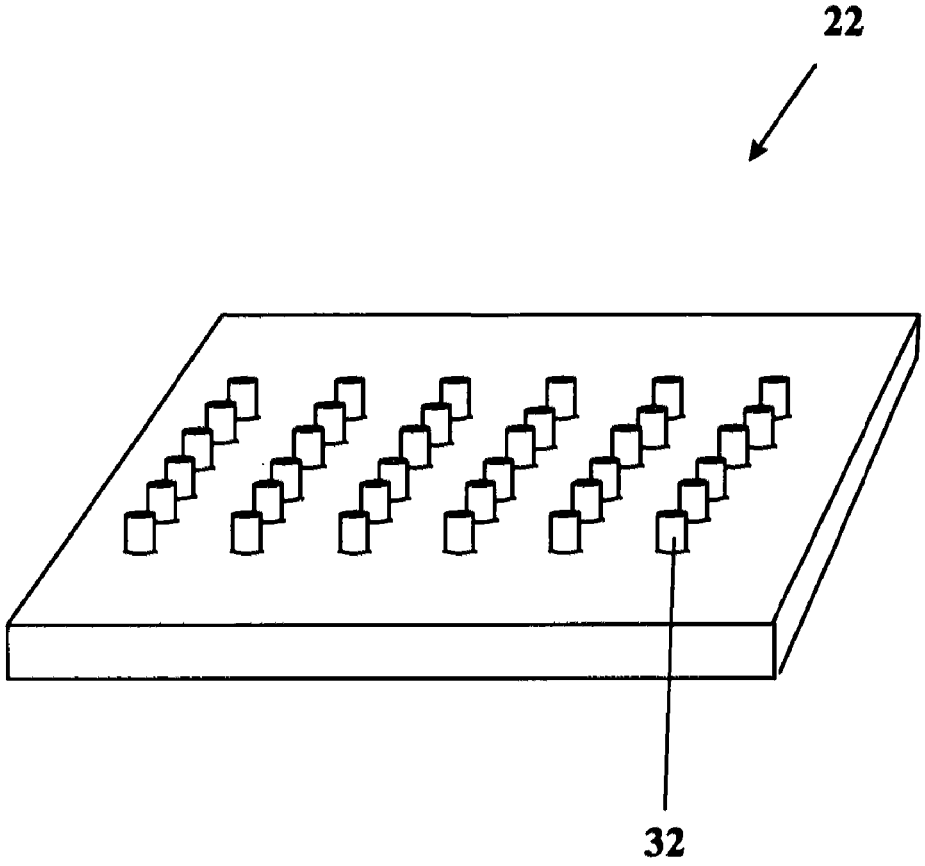
FIG. 7 is a schematic illustration of an array of thirty six distensions that are formed when the distensible elastic platen is aligned and held firmly in contact with a rigid platen having thirty six cavities, and the pressurized fluid has caused the elastic polymer to distend into the cavities.

FIG. 7 is a schematic illustration of an array of thirty six distensions 32 are formed when the distensible elastic platen 22 is aligned and held firmly in contact with the rigid platen 42 having thirty six cavities 44, and the pressurized fluid has caused the elastic polymer to distend into the cavities. Of course, the number and diameter of the distensions 32 are determined by the number and diameter of cavities.

Figure 8:
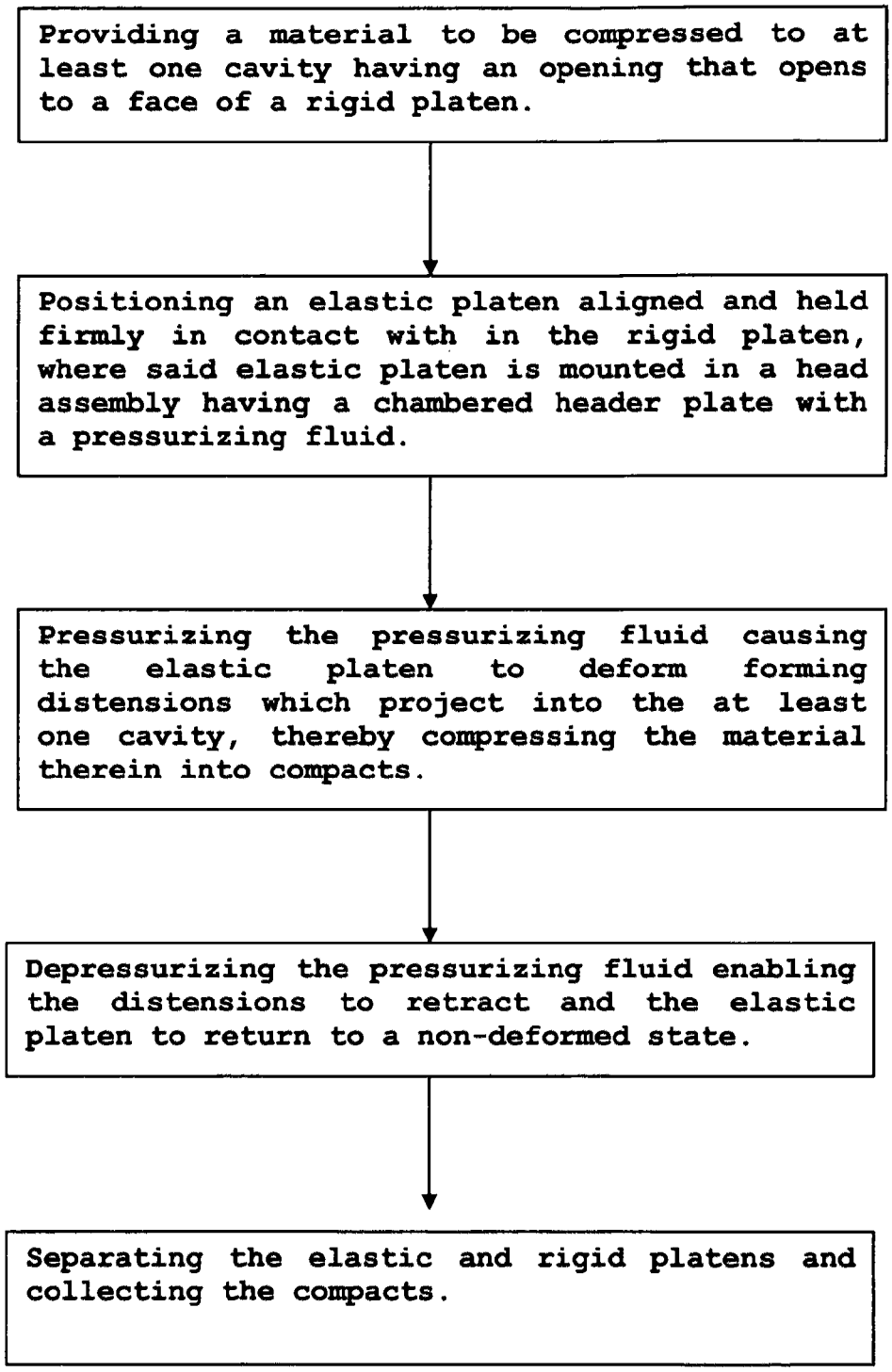
FIG. 8 is a flow diagram of the method wherein there is no evacuation step.

The method for compressing powders and the like is illustrated in FIG. 8. The method includes providing a material to be compressed in at least one cavity where each cavity has an opening that opens to a face of a rigid platen. The method further includes positioning an elastic platen being aligned and held firmly in contact with the rigid platen where the elastic platen is mounted in a head assembly having a chambered header plate with a pressurizing fluid; and pressurizing the pressurizing fluid causing the elastic platen to deform thereby forming distensions, which project into at least one cavity. As a result, the distensions compress the material therein into compact shapes. The pressuring fluid provides a uniform pressure to the elastic platen. Depressurizing the pressurizing fluid enables the distensions to retract and the elastic platen to return to a non-deformed state. The platens may be separated and the compact samples collected.

Figure 9:
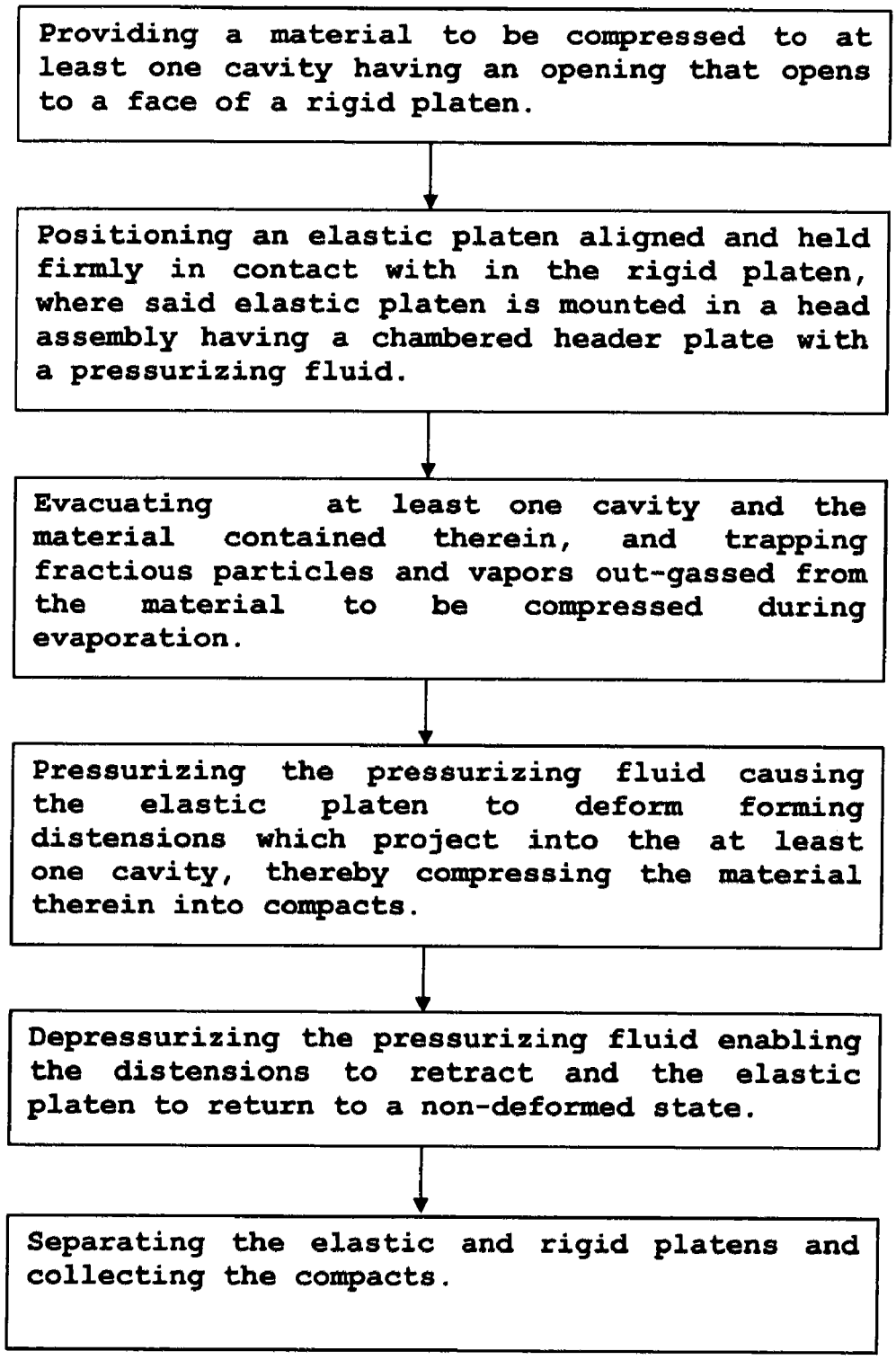
FIG. 9 is a flow diagram of the method wherein there is an evacuation step.

The method for compressing powders and the like can further include evacuating the cavities and the material contained in the cavities where this incremental step is illustrated in FIG. 9. Evacuation occurs after the cavities are loaded and the elastic platen is aligned and held firmly in contact with the rigid plate. Evacuation is suspended when the pressurizing fluid is depressurized enabling the distensions to retract and the elastic platen returns to a non-deformed state. In the method, the elastic and rigid platens are separated, and the compact (samples) are harvested. The compacts are miniature explosive charges having an optimized density where optimization refers to the reaction rate when the explosive charges are detonated. In an exemplary embodiment, generally, reaction rates are the highest.

The step of evacuating may further include trapping fractious particles and vapors out-gassed from the material to be compressed during evaporation. Various exemplary traps have previously been discussed, such as, diffusion membranes, and orthogonal micro-channels.

In the method, the material to be compressed may be small samples prepared using ink jet technology. The small samples may be created off line, or, in an exemplary embodiment, loaded directly into the cavities by an ink-jet device. The material is generally dispensed as a dispersion.

During the retraction step, the elastic platen elastic platen recovers to its non-deformed state. The elastic platen retracts uniformly and cleanly, not adhering to the cavity, nor to the material to be compressed, nor to the resulting compacts. In an exemplary embodiment, a suitable elastomeric polymer has been found to be polydimethylsiloxane (PDMS).

PDMS potentially could also be used to make an isostatic type of press where pressure is applied on the cavity as well as on the material to be compressed.

The apparatus and methodology are particularly applicable to MEMS safety and arming devices for military ordnance, including cheap and practical "salvage-fuzing" or autodestruct features for submunitions. The apparatus could also have commercial applications in the manufacture of such devices as sophisticated automobile airbag inflation systems, fire extinguisher cartridges, and aircrew escape devices. Other applications in the security arena would include micro-miniature and "stealth" destruct devices for microelectronics devices and systems, and micro-sized single-shot power sources for surveillance systems.

It is to be understood-d that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A method for compressing powders and the like, comprising:

providing a material for being compressed into at least one cavity, where said at least one cavity includes an opening that opens to a face of a rigid platen;

positioning an elastic platen for alignment and being held firmly in contact with the rigid platen, where said elastic platen is mounted in a head assembly, which includes a chambered header plate with a pressurizing fluid;

pressurizing the pressurizing fluid causing the elastic platen to deform forming distensions which project into the at least one cavity, thereby compressing the material therein into compacts, and depressurizing the pressurizing fluid enabling the distensions to retract and the elastic platen to return to a non-deformed state.

2. The method according to claim 1, further comprising separating the elastic and rigid platens and collecting the compacts.

3. The method according to claim 1, wherein said compacts are miniature explosive charges having an optimized density.

4. A method for compressing powders and the like, comprising:

providing a material for compressing to at least one cavity, where said at least one cavity includes an opening that opens to a face of a rigid platen;

positioning an elastic platen for alignment and being held firmly in contact with the rigid platen, where said elastic platen is mounted in a head assembly, which includes a chambered header plate with a pressurizing fluid;

evacuating said at least one cavity and the material contained therein;

pressurizing the pressurizing fluid causing the elastic platen to deform forming distensions, which project into said at least one cavity, thereby compressing the material therein into compacts, and depressurizing the pressurizing fluid enabling the distensions to retract and the elastic platen to return to a non-deformed state.

5. The method according to claim 4, further comprising separating the elastic and rigid platens and collecting the compacts.

6. The method according to claim 5, wherein said compacts are miniature explosive charges having an optimized density.

7. The method according to claim 4, wherein said evacuating further comprises trapping fractious particles and vapors out-gassed from the material compressed during evaporation.

8. The method according to claim 4, wherein the material are is small material samples created using ink-jet technology.

9. The method according to claim 7, wherein said trapping utilizes micro-channels, which are orthogonal to each other.

10. The method according to claim 7, wherein said trapping utilizes diffusion membranes.

11. The method according to claim 4, wherein said elastic platen is composed of an elastomeric polymer.

12. The method according to claim 11, wherein said elastomeric polymer is polydimethylsiloxane.

13. The method according to claim 4, wherein said providing a material for compression is implemented by an ink jet device, which deposits the material in said at least one cavity.

14. The method according to claim 13, wherein said material is a dispersion.

15. A method for compressing powders and the like, comprising:

providing a material for being compressed into at least one cavity, where said at least one cavity includes an opening that opens to a face of a rigid platen, wherein said rigid platen is comprised of an etched silicon wafer having micro-channels;

positioning an elastic platen for alignment and being held firmly in contact with the rigid platen, where said elastic platen is mounted in a head assembly, which includes a chambered header plate with a pressurizing fluid;

evacuating said at least one cavity and the material contained therein through the micro-channels; and pressurizing the pressurizing fluid causing the elastic platen to deform forming distensions, which project into said at least one cavity, thereby compressing the material therein into compacts.

16. The method according to claim 15, further comprising depressurizing the pressurizing fluid enabling the distensions to retract and the elastic platen to return to a non-deformed state.

17. The method according to claim 16, further comprising separating the elastic platen and the rigid platen, and collecting the compacts.

18. The method according to claim 15, wherein said compacts are miniature explosive charges having an optimized density.

* * * * *